US005415133A

United States Patent [19]

Noh

[11] Patent Number: 5,415,133

[45] Date of Patent: May 16, 1995

[54] ROOM HEATING HOT WATER BOILER

[76] Inventor: Kun W. Noh, 89-9, Bongcheon 3-dong, Kwanak-ku, Seoul, Rep. of Korea

[21] Appl. No.: 265,660

[22] Filed: Jun. 24, 1994

[30] Foreign Application Priority Data

Sep. 25, 1993 [KR] Rep. of Korea ..... 19535/1993

[51] Int. Cl.[6] ..... F22B 5/00

[52] U.S. Cl. ..... 122/16; 126/361; 122/14; 122/17

[58] Field of Search ..... 126/361; 122/13.1, 16, 122/17, 14

[56] References Cited

U.S. PATENT DOCUMENTS 4,438,728 3/1984 Fracaro ..... 122/17

4,632,066 12/1986 Kideys ..... 126/16

*Primary Examiner*—Carroll B. Dority

*Attorney, Agent, or Firm*—James D. Hall; Ken C. Decker

[57] ABSTRACT

A room heating hot water boiler is disclosed in which a plurality of longitudinal rectangular hexahedral water tank groups and a plurality of lateral hexahedral water tanks are disposed in four steps above a combustion chamber in such a manner as to communicate with each other, and guide projections are formed so that an exhaustion gas discharge conduit should be provided in a zig-zag form. Consequently, the heat transfer area is increased, and convection occurs through small and large paths, so that the water of the boiler can be speedily heated, thereby improving the heat efficiency of the boiler. A lower water tank 3 and a recovering tank 3A are formed around a combustion chamber 2 of the boiler body 1. A motor pump 4 is connected between the two water tanks 3 and 3A, and a plurality of longitudinal water tank groups **3*a* and 3*c* and a plurality of lateral water tanks 3*b* and 3*d* are alternately stacked in four steps. A hot water tank 3B is formed within the boiler body 1 in communication with an upper lateral water tank 3*e*, and a distribution valve 7 and a recovering valve 7*a* are formed respectively below and outside the hot water tank 3B and the recovering tank 3A. Further, a hot water supplying tube 11 is formed on the upper portion of the hot water tank 3B**.

4 Claims, 5 Drawing Sheets

ROOM HEATING HOT WATER BOILER

FIELD OF THE INVENTION

The present invention relates to a room heating hot water boiler in which a plurality of longitudinal rectangular hexahedral water tank groups and a plurality of lateral hexahedral water tanks are disposed in four steps above a combustion chamber in such a manner as to communicate with each other, and a hot water tank is made to surround the longitudinal and lateral tanks in such a manner as to communicate with the longitudinal and lateral tanks, thereby making it possible to supply hot water to heat the rooms and to the bath room and kitchen.

BACKGROUND OF THE INVENTION

In the prior art (Korean Utility Model Publication No. 88-2020) for which the present invention intends to improve, a plurality of longitudinal water tank groups and a plurality of lateral water tanks are disposed in two steps above a combustion chamber. A hot water tank is made to surround the longitudinal and lateral water tanks, and the lateral water tank supplies hot water to heat the rooms, while the hot water tank supplies hot water to the kitchen.

The above described conventional boiler has an advantages such that the use of the kitchen hot water is not affected by the temperature of the room heating hot water. However, the path for the convection current of water is limited within the longitudinal and lateral water tanks, and the conduit for the discharge of exhaustion gas is short. Further, heat radiating area is not large, and therefore, the thermal efficiency of the boiler is very low.

SUMMARY OF THE INVENTION

The present invention is intended to overcome the above described disadvantages of the conventional technique.

Therefore it is the object of the present invention to provide a room heating hot water boiler in which the thermal efficiency of the boiler is improved, so that the rooms can be heated in an efficient manner, and that hot water should be always available to the kitchen.

In achieving the above object, the boiler according to the present invention includes: a lower water tank and a recovering tank provided around a combustion chamber in the form of partitions; a motor pump connecting the two water tanks for forcibly carrying the water; a plurality of longitudinal rectangular hexahedral water tank groups and a plurality of lateral rectangular hexahedral water tanks installed in four steps above the lower water tank so as to form diversified convection paths and to speedily heat up the water; and a hot water tank installed within the boiler body across an exhaustion gas discharge conduit and communicating to the upper lateral water tank, wherein the room heating hot water is supplied from the hottest upper and inner water tank; the kitchen hot water is supplied from the upper portion of the hot water tank; the cooled water returning from the room heating pipes are recovered into the recovering tank; and the exhaustion gas discharge conduit is provided in a zig-zag form by providing guide projections between the rectangular hexahedral water tanks.

In the boiler according to the present invention, the water is heated by a burner which is installed within the combustion chamber, while the water of the recovering tank is transferred to the lower tank by a motor pump.

The water of the lower tank is heated, and at the same time, distributed into the plurality of the upper hexahedral longitudinal water tanks. At the same time, the combustion flames rise into between the longitudinal water tanks to heat up them, and the heated water is introduced into the lateral hexahedral water tanks to be mixed with the water of the lateral water tanks. Through such a mixing, the overall water gains a uniform temperature, and thus, the water is dispersed into the upper longitudinal hexahedral water tanks again. This water is heated up further, and then, dispersed into the lateral hexahedral water tanks again. Under this condition, the water of the hot water tank is further heated through the heat radiation of the exhaustion gas discharge conduit. The water which is heated up to the highest level is introduced into the hot water tank by the action of the motor pump. A part of the hot water is supplied through a distribution header to the room heating pipes of the respective rooms, while the cooled water returns to the recovering tank to be introduced into the lower tank.

The hot water for the kitchen and the bath room is supplied from the upper portion of the hot water tank. In an overall view, the water is well circulated through the plurality of the longitudinal water tanks and the lateral water tanks, with circulating paths being formed between the longitudinal and lateral water tanks, thereby maintaining a circulating and convection current. Thus the water is heated in an easy manner, and, owing to the gathering and dispersing of the water, the water is uniformly heated. Further, the user can select the room heating water and the kitchen and bath room water.

Further, the flame gas rising through between the longitudinal hexahedral water tanks is collided with the lateral hexahedral water tank so as to be dispersed. The gas is further collided with the guide projections formed on the inner walls of the boiler body. Further, the exhaustion gas discharge conduit is provided in a zig-zag form, so that the heat transfer area should be increased, thereby increasing the boiler efficiency.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
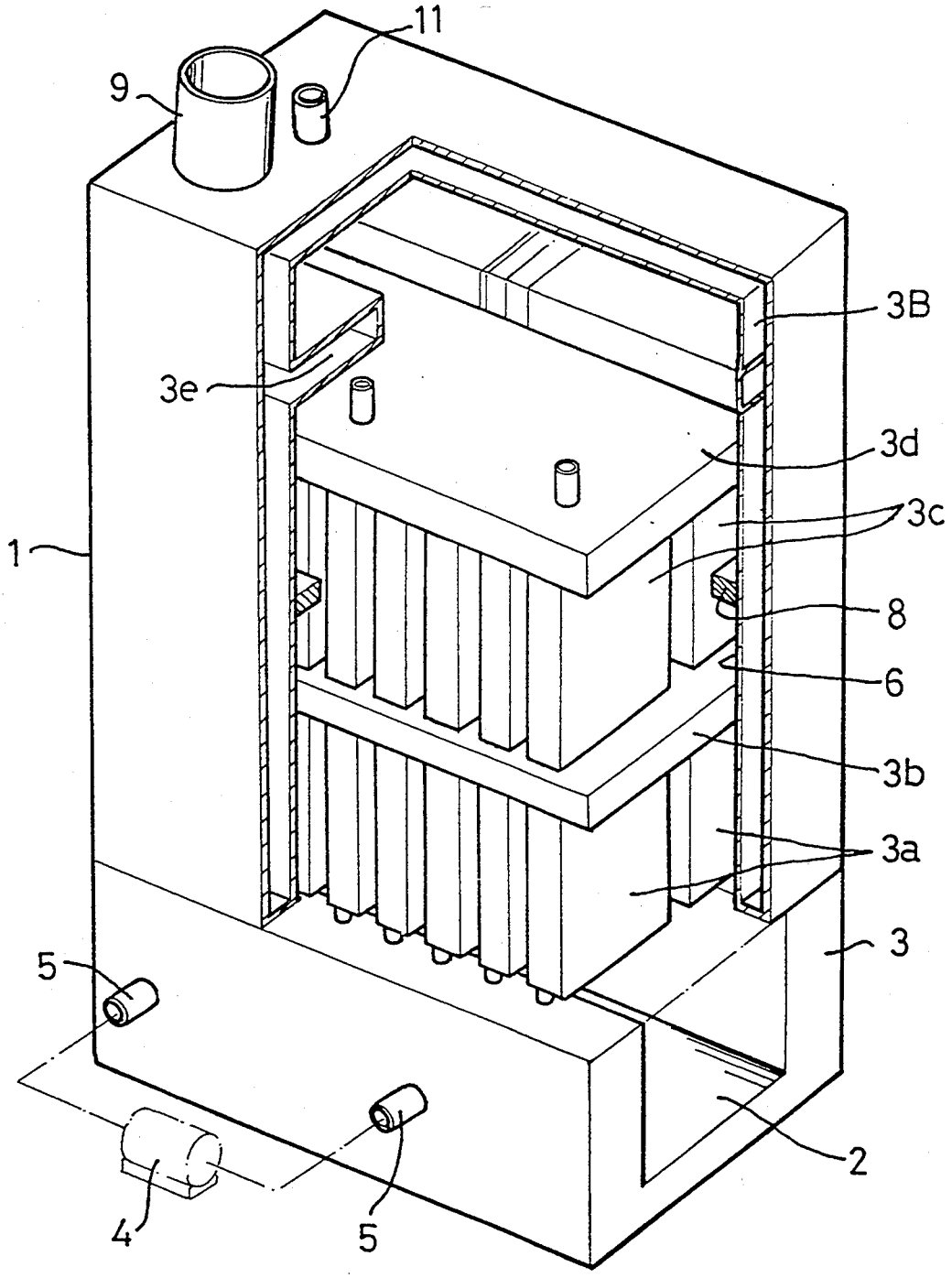
FIG. 1 is a partly cut-out frontal perspective view of the boiler according to the present invention.
Figure 2:
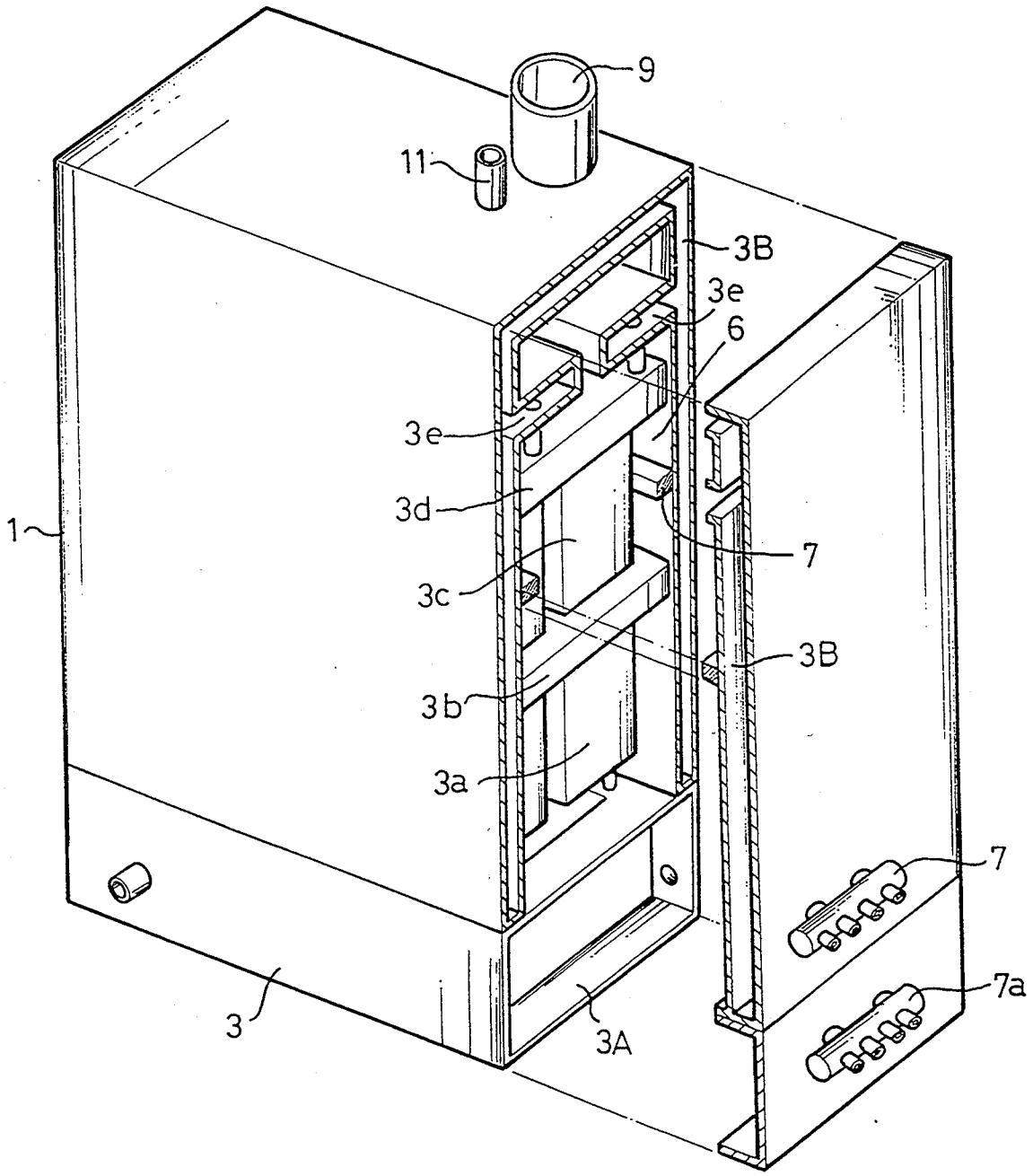
FIG. 2 is a partly cut-out rear perspective view of the boiler according to the present invention.
Figure 3:
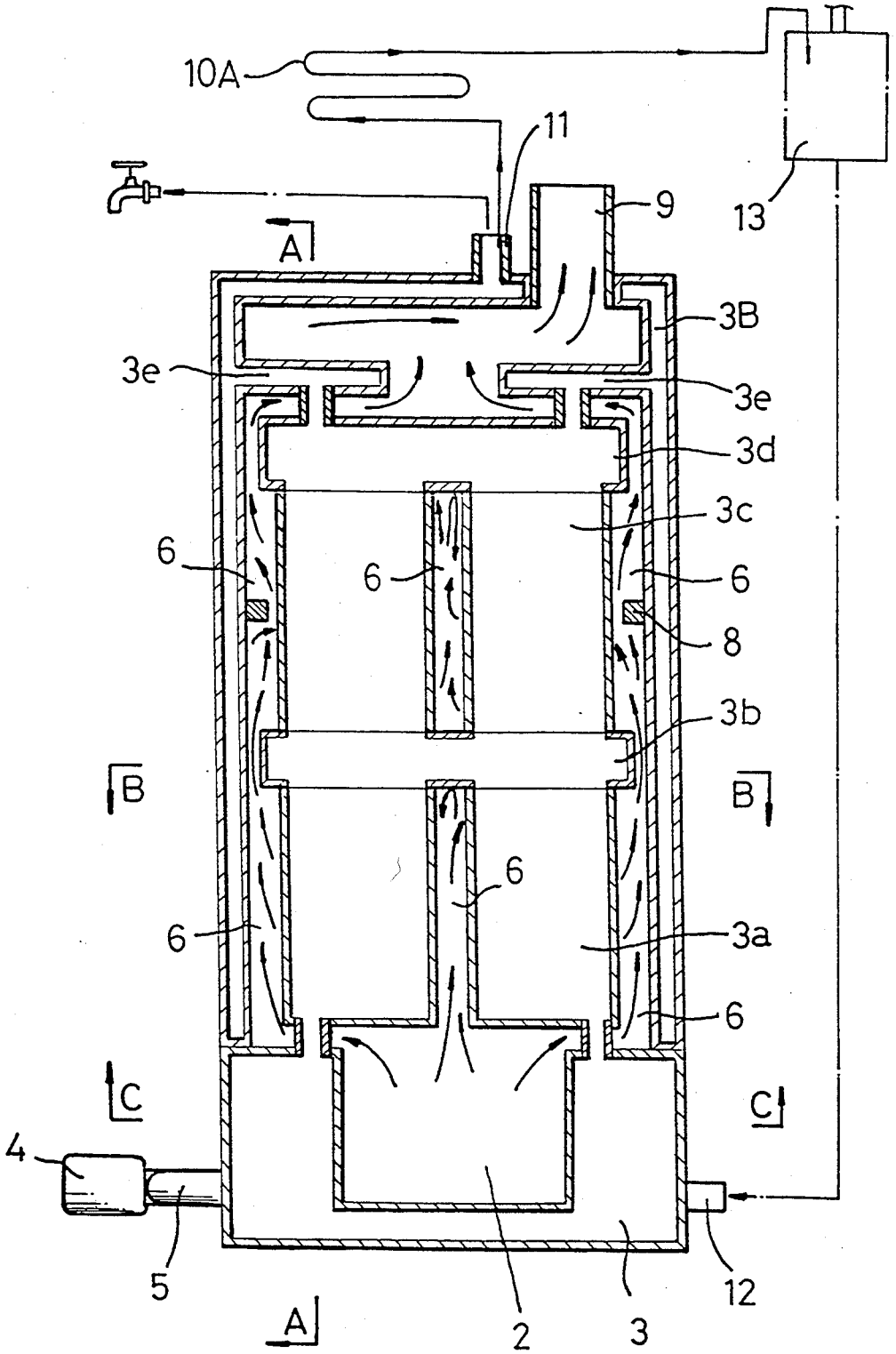
FIG. 3 is a longitudinal sectional view of the boiler according to the present invention.
Figure 4:
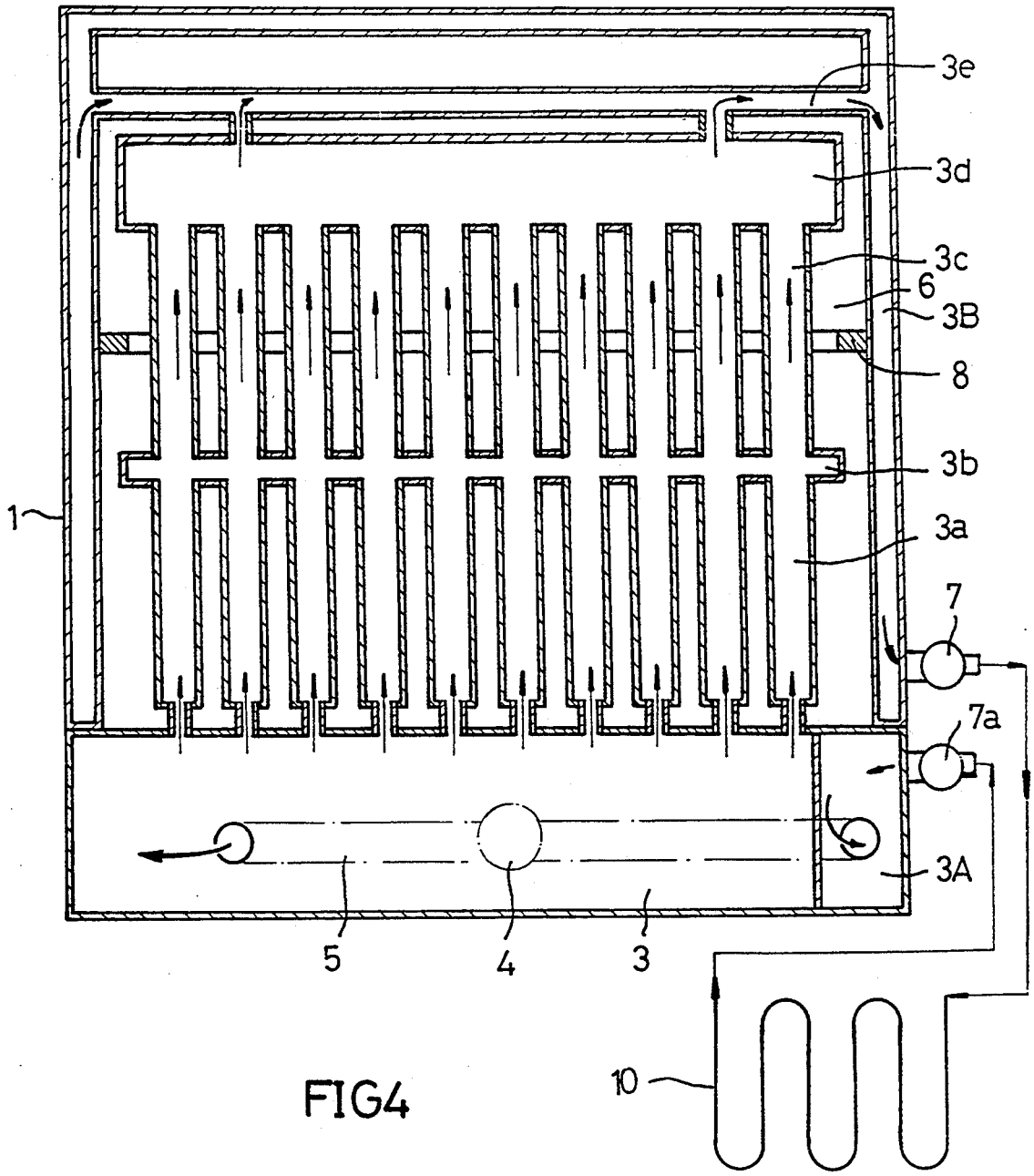
FIG. 4 is a sectional view taken along the line A—A of FIG. 3.
Figure 5:
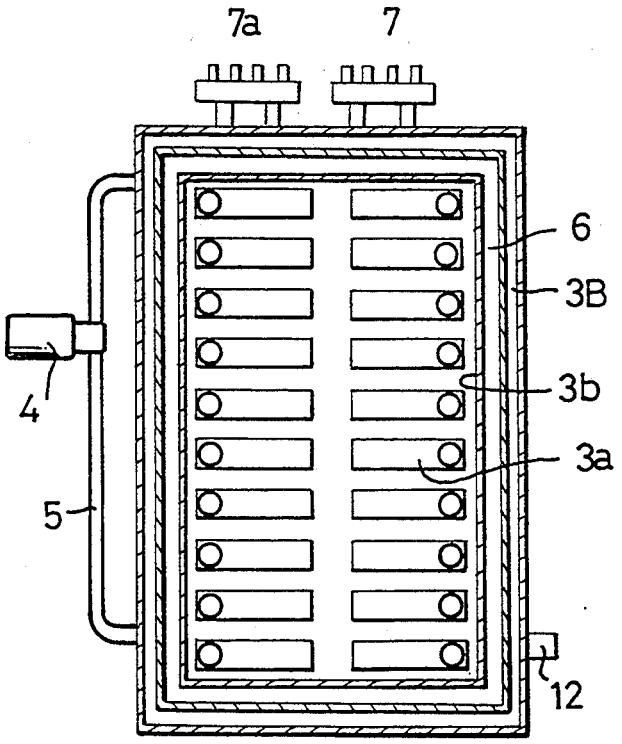
FIG. 5 is a sectional view taken along the line B—B of FIG. 3.
Figure 6:
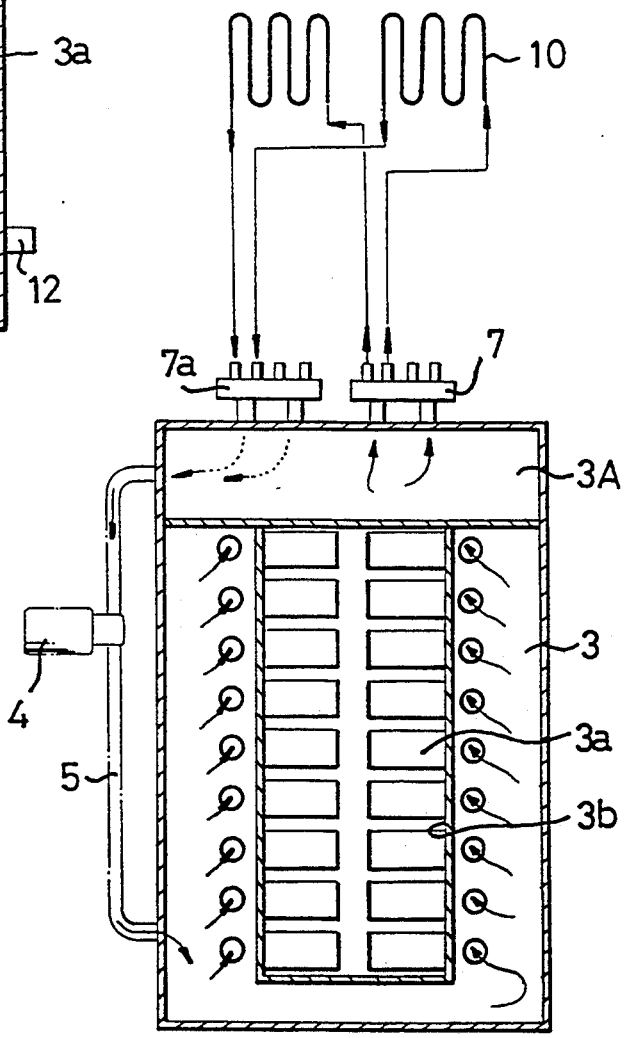
FIG. 6 is a sectional view taken along the line C—C of FIG. 3.

As shown in FIGS. 1 to 3, a lower tank 3 and a recovering tank 3A is separately installed around a combustion chamber 2 of a boiler body 1, and a motor pump 4 is connected between the two water tanks 3 and 3A by means of water pipes 5.

Above the lower water tank 3, there are installed a longitudinal rectangular hexahedral water tank group 3*a* and a lateral rectangular hexahedral water tank 3*b* in a mutually communicating manner. Upon the lateral water tank 3*b*, there are installed a longitudinal water tank group 3*c* and a lateral water tank 3*d* in a vertically connected manner. In total, four steps of such longitudinal and lateral water tank groups are provided.

Within the boiler body 1, there is installed a hot water tank 3B isolated from an exhaustion gas discharge conduit 6, and the upper portion of the hot water tank 3B is made to communicate with an upper lateral water tank 3*e* in an integral form. Below the hot water 3B of the boiler body 1 and outside the recovering tank 3A, there are formed a distribution valve 7 and a recovering valve 7*a*. The hot water is supplied through the distribution valve 7 to the room heating pipes 10, and the cooled water is made to return through the recovering valve 7*a* to the recovering tank 3A.

Within the boiler body 1, there is installed the hot water tank 3B isolated the exhaustion gas discharge conduit 6 in such a manner as to communicate with the upper lateral water tank 3*e*, so that the water of the hot water tank 3B of the boiler body 1 should be further heated by the exhaustion gas. A water pipe 11 is connected to the upper portion of the hot water tank 3B for supplying the hot water to the room heating pipes 10A and to the kitchen and to the bath room. Guide projections 8 are installed on the inner walls of the hot water tank 3B and within the spaces between the lateral water tanks 3*b* and 3*d*, so that the exhaustion gas discharge conduit 6 extending to an upper discharge pipe 9 should be formed in a zig-zag form, thereby increasing the heat transfer.

If the boiler is heated by means of a burner (not shown) which is installed within the combustion chamber 2, the water of the lower tank 3 is dispersed into the longitudinal water tank group 3*a*, and the water thus dispersed is further heated by the rising flame gas, while the water thus further heated is introduced into the lateral hexahedral water tank 3*b*. The hot water from the longitudinal water tank group 3*a* is mixed in the lateral water tank 3*b*, so that the water should become uniform in its temperature. Then the water is further heated, and dispersedly introduced into the upper longitudinal water tank group 3*c*. Then the water is further heated by the flame gas which has been dispersed by being collided with the lateral water tank 3*b*, and then, the water thus heated is introduced into the lateral water tank 3*d*. Under this condition, if the pump 4 does operate, the water circulates through the small and large paths between the longitudinal water tank groups 3*a* and 3*c* and the lateral water tanks 3*b* and 3*d*, so that the temperature of the water should rise.

Under this condition, the water of the hot water tank 3B of the boiler body 1 is heated by the radiating heat from the exhaustion gas discharge conduit 6, but the hot water tank 3B communicates with only the upper portion of the upper lateral water tank 3*e*, so that the convection should occur only within the hot water tank 3B of the boiler body 1, and that convection should scarcely occur in the overall contour. Therefore, the water of the hot water tank 3B and the upper lateral water tank 3*d* is in the hottest state.

Under this condition, if the pump 4 is activated, the water of the recovering tank 3A is introduced into the lower tank 3, and then, the water rises through the longitudinal water tank group 3*a* and the lateral water tank 3*b* so as to be heated in the process. Further, the water rises through the upper longitudinal water tank group 3*c* and the lateral water tank 3*d*, repeating dispersions and gatherings. Thus the heated water passes through the upper portion of the hot water tank 3B and through a distribution valve 7 so as to be supplied into the room heating pipes 10, thereby heating the room. After heating the room, the cooled water passes through the recovering valve 7*a* to be recovered into the recovering tank 3A. This heating and recovering process is repeated, and the upper portion of the hot water tank 3B also supplies the hot water to the kitchen and the bath room and to the room heating pipes 10A. The water from the room heating pipes 10A passes through a water tank 13, and further passes through a water supply tube 12 to be recovered into the lower tank 3. The room heating pipes 10A is used by the user if required.

Particularly, the exhaustion gas discharge conduit 6 is provided with guide projections 8, and thus, the exhaustion gas discharge conduit 6 is provided in a zig-zag form closely to the heat receiving surfaces of the lateral water tanks 3*b* and 3*d* and the longitudinal water tank groups 3*a* and 3*c*. This exhaustion gas discharge conduit 6 extending in a zig-zag form increases the heat exchange, thereby improving the heat efficiency of the boiler.

According to the present invention as described above, a plurality of longitudinal water tank groups and a plurality of lateral water tanks are provided in four steps in a mutually communicating manner, so that small and large paths should be formed, and that the convection of water should actively occur. Further, dispersions and gatherings of water occur, so that the water should be speedily and uniformly heated. Further, the heat receiving surface areas are increased, and therefore, the heat transfer become more efficient.

Further, the water of the upper lateral water tank is supplied through the hot water tank (disposed besides the exhaustion gas discharge conduit) to the room heating pipes, and therefore, always the maximally heated water is supplied, thereby making it possible to heat the rooms efficiently.

Further, the exhaustion gas discharge conduit is formed by a plurality of guide projections, and extends in a zig-zag form, so that the exhaustion gas discharge time should be extended, and that the heat transfer should be improved, thereby improving the boiler efficiency.

What is claimed is:

1. A room heating hot water boiler, comprising:

a lower water tank 3 and a water recovering tank 3A forming a combustion chamber 2;

a motor pump 4 connected between said lower water tank 3 and said recovering water tank 3A through water pipes 5;

a longitudinal hexahedral water tank group 3*a* and a lateral hexahedral water tank 3*b* disposed upon said lower water tank 3;

a longitudinal water tank group 3*c* and a lateral water tank 3*d* disposed thereupon;

an upper lateral water tank 3*e* located on said lateral water tank 3*d*; and means forming a hot water tank 3B about all of said previously mentioned tanks, means forming an exhaust gas discharge conduit 6 from said combustion chamber and through said boiler to heat said tanks, all of said tanks connected in fluid communication for passage of water through said boiler.

2. The room heating hot water boiler as claimed in claim 1, wherein a distribution valve 7 is installed in a lower portion and outside said hot water tank 3B, and a recovering valve *7a* is installed outside and in communication with said recovering tank 3A.

3. The room heating hot water boiler as claimed in claim 1, wherein guide projections 8 are provided between said lateral water tanks *3b* and *3d* and in said means forming said exhaustion gas discharge conduit 6, so that said exhaustion gas discharge conduit should be provided in a zig-zag form.

4. The room heating hot water boiler as claimed in claim 1, wherein a kitchen water supplying pipe 11 is connected to an upper portion of said hot water tank 3B of said boiler.

* * * * *